US008079186B2

(12) United States Patent
Williams

(10) Patent No.: US 8,079,186 B2
(45) Date of Patent: Dec. 20, 2011

(54) SOFFIT SYSTEM

(76) Inventor: Douglas Williams, Northbrook, IL (US)

( * ) Notice: Subject to any disclaimer, the term of this patent is extended or adjusted under 35 U.S.C. 154(b) by 314 days.

(21) Appl. No.: 12/341,865

(22) Filed: Dec. 22, 2008

(65) Prior Publication Data

US 2010/0154322 A1 Jun. 24, 2010

(51) Int. Cl.
*E04B 1/52* (2006.01)
*E04B 9/00* (2006.01)

(52) U.S. Cl. ..... 52/220.6; 52/506.06; 52/506.08

(58) Field of Classification Search ..... 52/287.1, 52/220.6, 506.01, 506.05, 506.06, 506.07, 52/506.08, 506.09, 506.1, 582.1, 586.1, 586.2, 52/585.1, 589.1, 590.1, 590.2, 590.3, 591.1, 52/592.1, 592.3, 592.4, DIG. 8, 94, 95; 403/339, 403/354, 408.1, 409.1
See application file for complete search history.

(56) References Cited

U.S. PATENT DOCUMENTS

| | | | | |
|---|---|---|---|---|
| 1,981,742 | A | 11/1934 | Murphy | |
| 2,734,126 | A * | 2/1956 | Kruger | 362/150 |
| 3,229,029 | A | 1/1966 | Weiss | |
| 3,347,275 | A | 10/1967 | Murphy | |
| 3,360,896 | A * | 1/1968 | Wright | 52/506.09 |
| 3,405,488 | A | 10/1968 | Nelson | |
| 3,697,667 | A | 10/1972 | Pollak et al. | |
| 3,761,603 | A | 9/1973 | Hays et al. | |
| 3,786,171 | A | 1/1974 | Shira | |
| 3,821,688 | A | 6/1974 | Larsille | |
| 3,857,216 | A * | 12/1974 | Sherman | 52/506.06 |
| 3,858,377 | A * | 1/1975 | Browne et al. | 52/775 |
| 3,927,698 | A | 12/1975 | Johannsen | |
| 4,017,137 | A | 4/1977 | Parks | |
| 4,294,054 | A | 10/1981 | Kuhr | |
| 4,391,426 | A | 7/1983 | Gothberg | |
| 4,423,284 | A | 12/1983 | Kaplan | |
| 4,549,375 | A | 10/1985 | Nassof | |
| 4,593,505 | A | 6/1986 | Russell | |
| 4,627,469 | A | 12/1986 | Buard | |
| D288,802 | S | 3/1987 | Bramwell | |
| 4,902,124 | A | 2/1990 | Roy, Sr. et al. | |
| 4,907,767 | A | 3/1990 | Corsi et al. | |
| 4,942,271 | A | 7/1990 | Corsi | |
| 5,235,136 | A | 8/1993 | Santucci et al. | |
| 5,243,800 | A | 9/1993 | Olbrich | |
| 5,274,972 | A | 1/1994 | Hansen | |
| 5,406,762 | A | 4/1995 | Buard | |
| 5,611,185 | A * | 3/1997 | Wilz | 52/506.07 |
| 5,732,747 | A | 3/1998 | Holliday | |
| 5,791,093 | A * | 8/1998 | Diamond | 52/36.5 |

(Continued)

FOREIGN PATENT DOCUMENTS

| | | |
|---|---|---|
| EP | 403 440 | 12/1990 |

(Continued)

*Primary Examiner* — Brian Glessner
*Assistant Examiner* — Beth Stephan

(57) ABSTRACT

A soffit system is disclosed and has elongate first and second soffit components. Each soffit component includes a support flange and a sidewall integrally connected to one another along a lengthwise joint. A connector is carried on each of the sidewalls. A connector leg is carried on each of the sidewalls that is spaced from and parallel to the second joint. The connector and the connector leg extend in a lengthwise direction. Each sidewall is oriented at a non-parallel angle relative to each support flange, respectively. The first connector and the second connector are pushed toward one another to selectively join the first and second soffit components, and are pulled apart to separate the first and second soffit components.

25 Claims, 12 Drawing Sheets

U.S. PATENT DOCUMENTS

| | | | | |
|---|---|---|---|---|
| 5,791,810 | A | 8/1998 | Williams | |
| D403,543 | S | 1/1999 | Grasso et al. | |
| 6,082,071 | A * | 7/2000 | Richardson | 52/718.04 |
| 6,084,180 | A | 7/2000 | De Bartolo, Jr. et al. | |
| 6,115,982 | A * | 9/2000 | Lindenberg | 52/506.05 |
| 6,235,988 | B1 * | 5/2001 | Karst et al. | 174/505 |
| 6,287,046 | B1 | 9/2001 | Neuhofer et al. | |
| 6,412,250 | B2 * | 7/2002 | Davis | 52/834 |
| 6,467,226 | B2 * | 10/2002 | Dodson et al. | 52/220.1 |
| 6,502,357 | B1 * | 1/2003 | Stuthman et al. | 52/241 |
| 6,603,073 | B2 | 8/2003 | Ferris | |
| 6,632,994 | B1 | 10/2003 | Mangone et al. | |
| 6,727,434 | B2 | 4/2004 | Jadaud et al. | |
| 6,803,519 | B2 | 10/2004 | De la Borbolla et al. | |
| D498,211 | S | 11/2004 | Thibault | |
| 6,972,367 | B2 | 12/2005 | Federspiel et al. | |
| 7,093,394 | B1 * | 8/2006 | McNamara et al. | 52/35 |
| D539,755 | S | 4/2007 | Makwinski | |
| 7,200,970 | B2 * | 4/2007 | Koenig et al. | 52/287.1 |
| 7,226,022 | B2 | 6/2007 | Bernard et al. | |
| 7,313,893 | B2 * | 1/2008 | Voegele, Jr. | 52/461 |
| 7,326,863 | B2 | 2/2008 | Herzog | |
| 7,739,848 | B2 * | 6/2010 | Trout | 52/581 |
| 7,823,333 | B2 * | 11/2010 | Kim | 52/36.5 |
| 2003/0192268 | A1 * | 10/2003 | Zaborowski | 52/220.6 |
| 2006/0096203 | A1 | 5/2006 | Weinstein | |
| 2007/0251183 | A1 * | 11/2007 | Thiagarajan et al. | 52/590.1 |
| 2010/0077688 | A1 * | 4/2010 | Bowen | 52/506.09 |

FOREIGN PATENT DOCUMENTS

| | | |
|---|---|---|
| EP | 1 102 375 | 7/2005 |
| GB | 1 104 584 | 2/1968 |
| GB | 2 128 223 | 4/1984 |
| GB | 2 379 676 | 3/2003 |
| GB | 2 413 338 | 10/2005 |
| WO | WO 2005/052277 | 6/2005 |

* cited by examiner

SOFFIT SYSTEM

BACKGROUND

1. Field of the Disclosure

The present disclosure is generally directed to soffits for enclosing obstructions on ceilings or walls, and more particularly to a soffit system for mounting and joining panels to cover such obstructions.

2. Description of Related Art

Soffits are often constructed of permanent wood framing and wall board. A soffit is often constructed around an obstruction that projects from the plane of a ceiling. A number of devices and systems are also known in the art that mount and support suspended or dropped ceiling panels, ceiling tiles, acoustical tiles, wall panels, or the like. These systems and devices can sometimes be configured to create a soffit around an obstruction on a wall or ceiling. Such devices and systems are generally configured with distinctive features that are specific to a particular panel structure or application. Once installed, many devices and systems, like framing and wallboard, make it difficult or impossible to remove and replace individual panels to access the object covered.

A wall or ceiling obstruction can vary, but these often include water pipes, steam pipes, electrical conduit, air ducts, and the like. These obstructions are sometimes enclosed using non-removable materials such as wood framing, wallboard, or plywood. Sometimes, permanent panel-mounting grid systems can be cut, shaped, and riveted or fastened in place to mount panels that enclose an obstruction. However, the systems and components are often difficult and laborious to install in such a manner, and not easily removed for access or changing components. Unfortunately, it is sometimes necessary to access the obstruction for service, repair, or replacement.

Connecting devices in the prior art are known that can accommodate a specific soffit application to connect adjacent panels around an obstruction. U.S. Pat. No. 4,294,054 (Kuhr) discloses a soffit system for a suspended ceiling that employs a system of hangers, clips, brackets, runners, screws, fasteners, and u-shaped channels, among other things, to support ceiling tiles. In another example, U.S. Pat. No. 4,549,375 (Nassof) discloses a snap-in, metal ceiling panel for a suspended ceiling that employs brackets, metal riser plates, metal ceiling panels, among other things, to form a soffit of a suspended ceiling. The soffits of Kuhr and Nassof are not easily removed for access, and are rather complex and time consuming to install.

SUMMARY OF THE DISCLOSURE

One example of a soffit system disclosed herein employs at least two elongate soffit connecting components or strips that, when interconnected, can support ceiling panels, ceiling tiles, acoustic tiles, wall panels, or the like. When two pairs of the two soffit components are used to support a panel and to surround obstructions protruding from walls or ceilings, a three-sided soffit enclosure is formed. The present system is configured to permit the soffit component strips to be easily and selectively engaged or assembled and disengaged or disassembled. The disclosed soffit system does not require an additional ceiling treatment, as it can be installed with no gaps and no exposed mechanisms against an existing ceiling.

In one example, a soffit system includes a first soffit component for attachment to a substrate, such as a joist, and a second soffit component for supporting a ceiling panel, for instance. The first soffit component has a length and, when viewed in cross-section, a first support flange and a first sidewall. The first support flange and the first sidewall are joined along a lengthwise seam. The first support flange and the first sidewall each have an inside surface oriented relative to one another typically, but not necessarily, at an angle of 90 degrees. The first sidewall carries a first connector leg on the inside surface of the first sidewall. Similarly, the second connector component has a length, a second support flange, and a second sidewall. The second support flange and the second sidewall are joined along a lengthwise seam. The second support flange and the second sidewall each have an inside surface oriented relative to one another also typically, but not necessarily, at an angle of 90 degrees. The second sidewall carries a second connector leg on the inside surface of the second sidewall.

The basic soffit system is formed of two soffit components. The second component can be identical to the first component, but oriented relative to the first component so that the sidewall and the connector leg of the first soffit component and the sidewall and the connector leg of the second soffit component confront each other as mirror images. When the second sidewall and the second connector leg are placed in a confronting position relative to the first sidewall and the first connector leg, the first and second soffit components can be interconnected by pushing the respective sidewalls and the connector legs together. Then, the second soffit component is retained in a connected arrangement with the first soffit component.

The soffit components can be used in pairs, for a total of four soffit components, in conjunction with a ceiling panel or the like, to form a three-sided soffit enclosure for enclosing obstacles encountered during installation of ceilings and walls. In such case, the second support flange of each pair of soffit components, together, can support a ceiling panel or other similarly shaped load by two opposed edges of the panel.

In one example, a key can be used to interconnect two soffit components so that an outside surface of the first sidewall is coplanar with an outside surface of the second sidewall when the soffit system is assembled around an obstruction. The key can have a length and two edges. When a key is used, each edge of the key can be retained between a sidewall and a connector leg of a respective one of the soffit components.

In one example, an L-shaped support component can be used, as an alternative for a first soffit component, in combination with a second soffit component as described above. The support component can have a length and, when viewed in cross section, a support flange, and a sidewall. The support flange can integrally connect to the sidewall along a lengthwise seam. The support flange and the sidewall each have an inside surface oriented relative to one another typically, but not necessarily, at an angle of 90 degrees. The support component in this example has no discrete connector leg. When the first sidewall of the support component and the second sidewall and the connector leg of the second soffit component are placed in a confronting position relative to each other, the support component and the second soffit component can be interconnected by pushing the first sidewall between the second sidewall and the connector leg carried on the second sidewall. Then, the sidewall of the first component is retained between the second sidewall and the connector leg of the second component. In this example, the free edge of the first sidewall creates a first connector captured between the second sidewall and second connector leg.

In one example, the first support flange and the first sidewall can be connected along a lengthwise seam that is a live joint or living hinge. The live joint allows the angle between the flange and the sidewall to vary if the substrate to which the soffit system attaches varies from level, or is inclined relative to the ultimate installed panel orientation.

In one example, a panel for a ceiling or the like can be attached with screws to the second support flange, or flanges if used in pairs, of soffit components.

In other examples, the lengths of the sidewalls of the soffit components can vary to accommodate varying installation requirements. Panels of various materials can be mounted using the disclosed soffit system to cover beams, ducts, or piping in an aesthetic, economical, three-dimensional manner.

The soffit components of the disclosed soffit systems can be extruded from PVC or other suitable plastic materials. In addition, the soffit systems can be manufactured in a wide variety of other materials, depending on the suitability of a material to a particular use. Other features and advantages of the soffit systems are illustrated in more detail in the attached figures and detailed description.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

The disclosed soffit system represents an advance over the prior art. Prior art devices provide soffit systems that join and support panels to cover obstructions on a flat wall or ceiling, but such systems are complex and difficult and/or time consuming to install. The prior art systems also do not readily disassemble and reassemble for access to the obstruction. The disclosed soffit system has a relatively simple and straightforward design. The disclosed soffit system employs two basic components. The two soffit components can be selectively connected to one another without the need for additional fasteners or fastening steps. In one example, two component strips attach directly to one another, and screws or the like are used to install one of the components to the wall or ceiling. In another embodiment, a key is used to interconnect two soffit components.

The disclosed soffit system is easy to assemble and install and is relatively simple and economical to manufacture. The disclosed soffit system readily supports panels to form a soffit enclosure around beams, pipes, ducts, columns, conduit, and similar structures, obstructions, and the like. The soffit components can easily be detached from one another without tools to release a panel supported by the system and to allow access to the object enclosed. The components can then be replaced, again without tools. Ceiling panels, wall panels, and tiles, once mounted using the soffit system, are easy to remove, reinstall, replace, or substitute.

Figure 1:
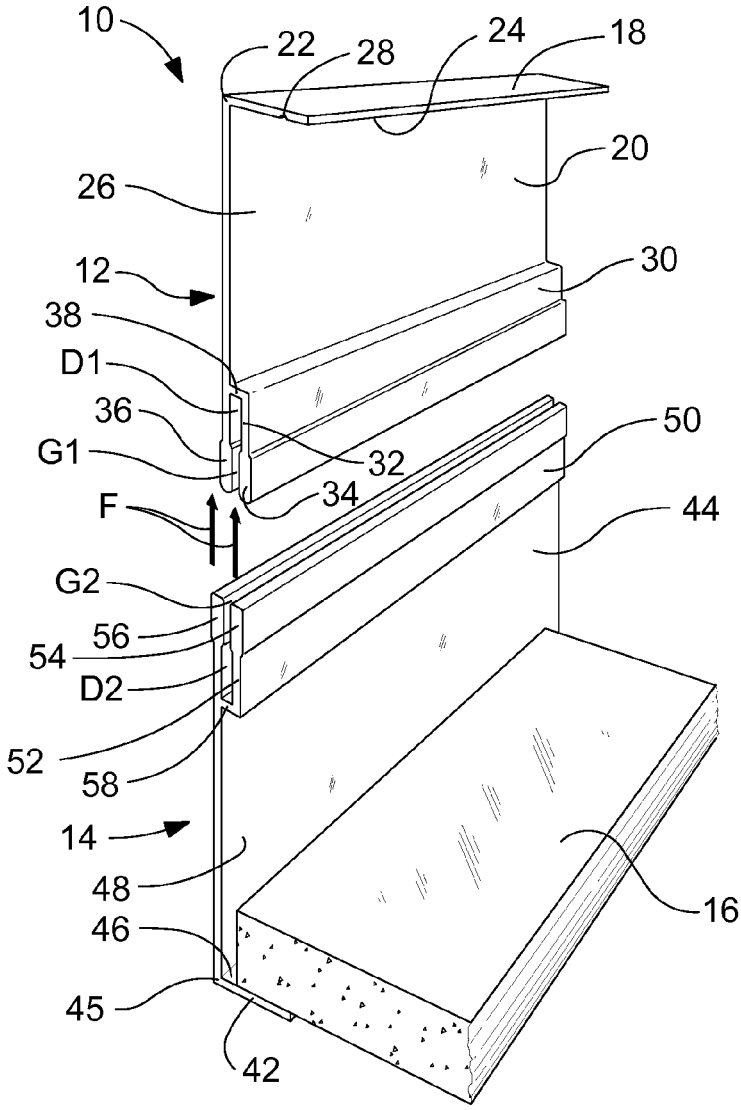
FIG. 1 shows a perspective, lengthwise fragmentary view of one example of part of a soffit system according to the teachings of the present invention with two component strips disconnected.
Figure 2:
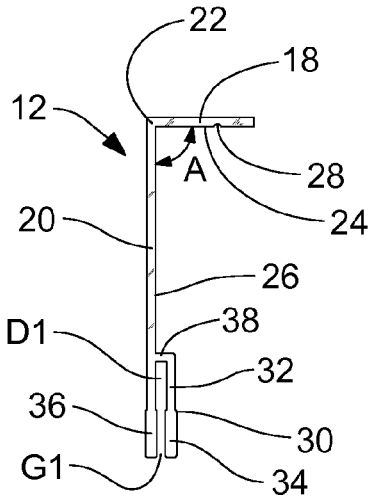
FIG. 2 shows an end view of one of the soffit components of the system in FIG. 1.

Turning now to the drawings, FIGS. 1 through 3A illustrate one example of a soffit system 10 that has a first soffit component 12 and a second soffit component 14 configured for supporting a structural or decorative panel 16. FIGS. 1 and 2 show the first soffit component 12, which has a length, a first support flange 18, and a first sidewall 20. The first support flange 18 and the first sidewall 20 are joined along a lengthwise seam at a first joint 22. The first support flange 18 and the first sidewall 20 each have an inside surface 24, 26. As shown in FIG. 2, the first support flange 18 and the first sidewall 20 are oriented relative to one another at a non-parallel angle A, typically, but not necessarily, at an angle of 90 degrees. The angle A can vary and remain within the teachings of the present invention. The first support flange 18 has a fastener groove 28 running along its length on the inside surface 24. The first sidewall 20 carries a first connector leg 30. The first connector leg 30 in this example has a stem section 32 that is attached to the inside surface 26 of sidewall 20 by an elbow 38. The stem section 32 with the elbow 38 is essentially L-shaped when viewed on end as in FIG. 2. The stem section 32 is parallel to and spaced from the inside surface 26 of the sidewall 20 by a distance D1.

Similarly, also shown in FIG. 1, the second soffit component 14 has a length. The second component 14 further has a second support flange 42 and a second sidewall 44. The second support flange 42 and the second sidewall 44 are joined along a lengthwise seam at a second joint 45. The second support flange 42 has an inside surface 46, and the second sidewall 44 has an inside surface 48. The second support flange 42 and the second sidewall 44 are oriented relative to one another at a non-parallel angle B, also typically, but not necessarily, at an angle of 90 degrees. The angle B can vary and remain within the teachings of the present invention. The second sidewall 44 carries a second connector leg 50. The connector leg 50 has a stem section 52 that is attached to the inside surface 48 of sidewall 44 by an elbow 58. The stem section 52 with the elbow 58 is essentially L-shaped when viewed on end as in FIG. 3. The stem section 52 is parallel to and spaced from the inside surface 48 of sidewall 44 by a distance D2.

Each connector leg 30, 50 has a free edge on the corresponding stem section 32, 52. Each connector leg 30, 50 also has a respective head section 34, 54 that is somewhat paddle-shaped and positioned on the free edge of the corresponding stem 32, 52. The heads 34, 54 have a greater thickness than the stems 32, 52. Each sidewall 20, 44 also has a free edge that also has a respective paddle-shaped head section 36, 56 on the free edge. The heads 36, 56 have a greater thickness than the thickness of the sidewalls 20, 44. A gap G1 is created between head section 34 and head section 36 at the free edges of the first sidewall 20 and the first connector leg 30. The gap G1 is narrower than the distance D1. A second gap G2 is created between the head section 56 and 54 at the free edges of the second sidewall 44 and the second connector leg 50. The gap G2 is narrower than the distance D2. Each distance D1, D2 is approximately equal to the thickness of each corresponding head section 34, 36, 54, 56. The size of each gap G1, G2 is approximately equal to the thickness of each corresponding sidewall 20, 44 or connector stein 32, 52. Each head 34, 36, 54, 56 also has a rounded tip and ramps that transition from sides of the head to adjacent side surfaces of the corresponding stem or flange section.

Figure 3:
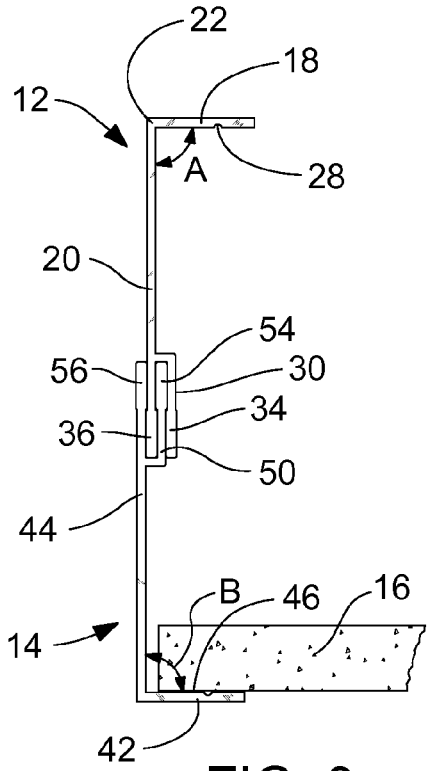
FIG. 3 shows an end view of the soffit components of FIG. 1 in an assembled state.
Figure 3A:
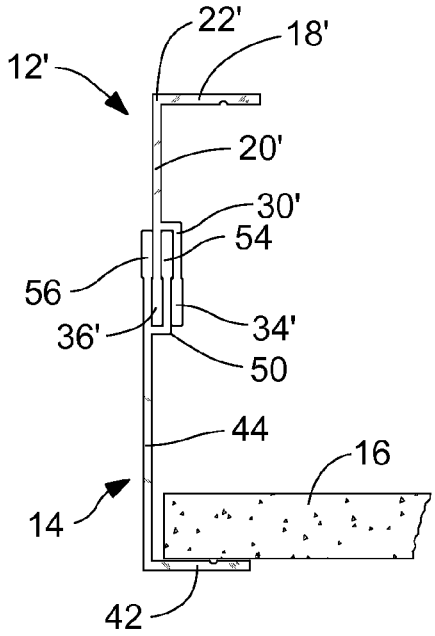
FIG. 3A shows an end view of one example of an assembled alternate soffit system in which a sidewall length of a first soffit component differs from a sidewall length of a second soffit component.

For assembly, two soffit components 12, 14 are placed so that the free edges of the sidewalls 20, 44 and the free edges of the connector legs 30, 50 are in a confronting position as shown in FIG. 1. Assembly of the first and second soffit components 12, 14 is then accomplished by pushing the first component 12 and the second component 14 together as indicated by the arrows F in FIG. 1. A head section 54 of the second connector leg 50 of the second soffit component 14 passes between the head 36 of the sidewall 20 and the head 34 of the first connector leg 30. Simultaneously, the head section 36 of the first sidewall 20 of the first soffit component 12 passes between the head 56 of sidewall 44 and the head 54 of the second connector leg 50. As illustrated by FIGS. 3 and 3A, when the two soffit components 12, 14 are assembled, the head 54 of the second connector leg 50 interferingly fits in the space D1 between the first sidewall 20' and the first connector leg 30' and is positively retained. Also, the head 36' of the first sidewall 20' interferingly fits in the space D2 between the second sidewall 44 and the second connector leg 50 and is positively retained.

Also shown in FIGS. 3 and 3A, the lengths of the sidewalls 20, 44 of the first and second soffit components can be identical or can vary. In the example of FIG. 3A, a first soffit component 12' has a support flange 18', and a first sidewall 20' that can be shorter or longer than the sidewall 20 of FIG. 3. The first soffit component 12' further has a connector leg 30' and heads 34', 36' that form a connector to interconnect with a second soffit component such as soffit component 14 of FIG. 3.

Figure 4:
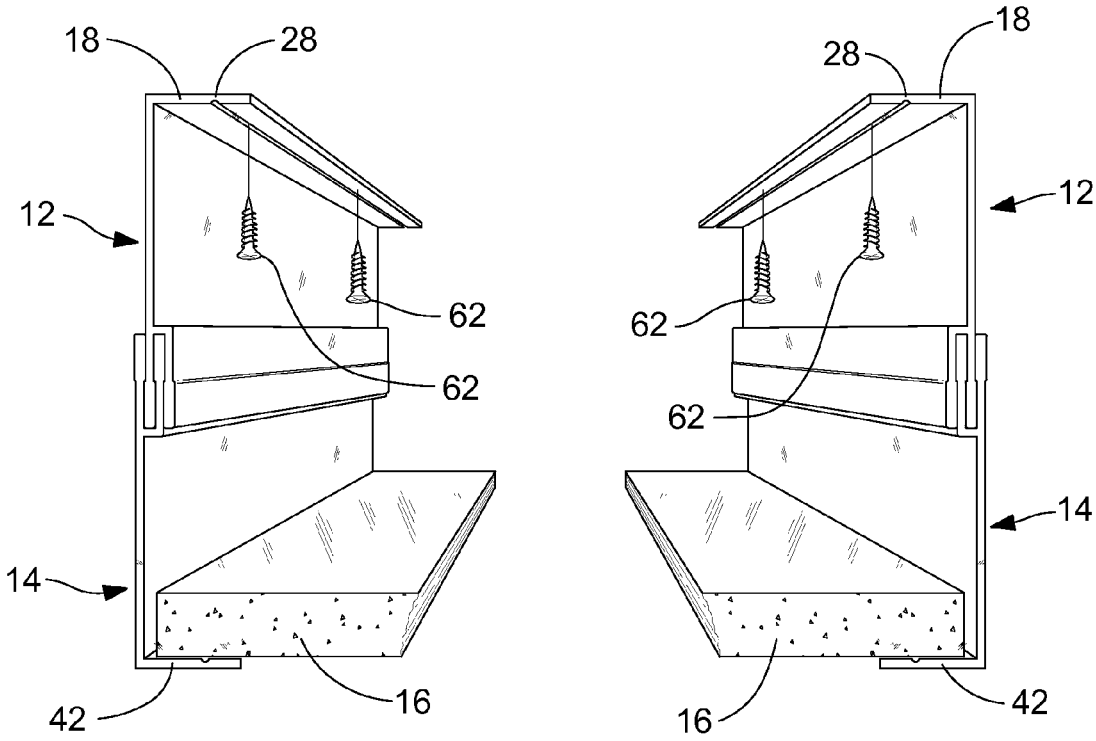
FIG. 4 shows a perspective view of an assembled soffit system of FIG. 3 with two pairs of the soffit components supporting a panel and forming a soffit enclosure.

FIG. 4 shows two pairs of the first and second soffit components 12, 14 as assembled. Screws 62 are shown aligned with the fastener groove 28. Two pairs of soffit components 12, 14 can support a ceiling panel, or other similarly shaped load, by two opposed edges of the panel 16 supported on two facing support flanges 42 of the second soffit components 14. To install the soffit system, the screws 62 can be screwed through the fastener groove 28 of the first soffit component 12.

Figure 5:
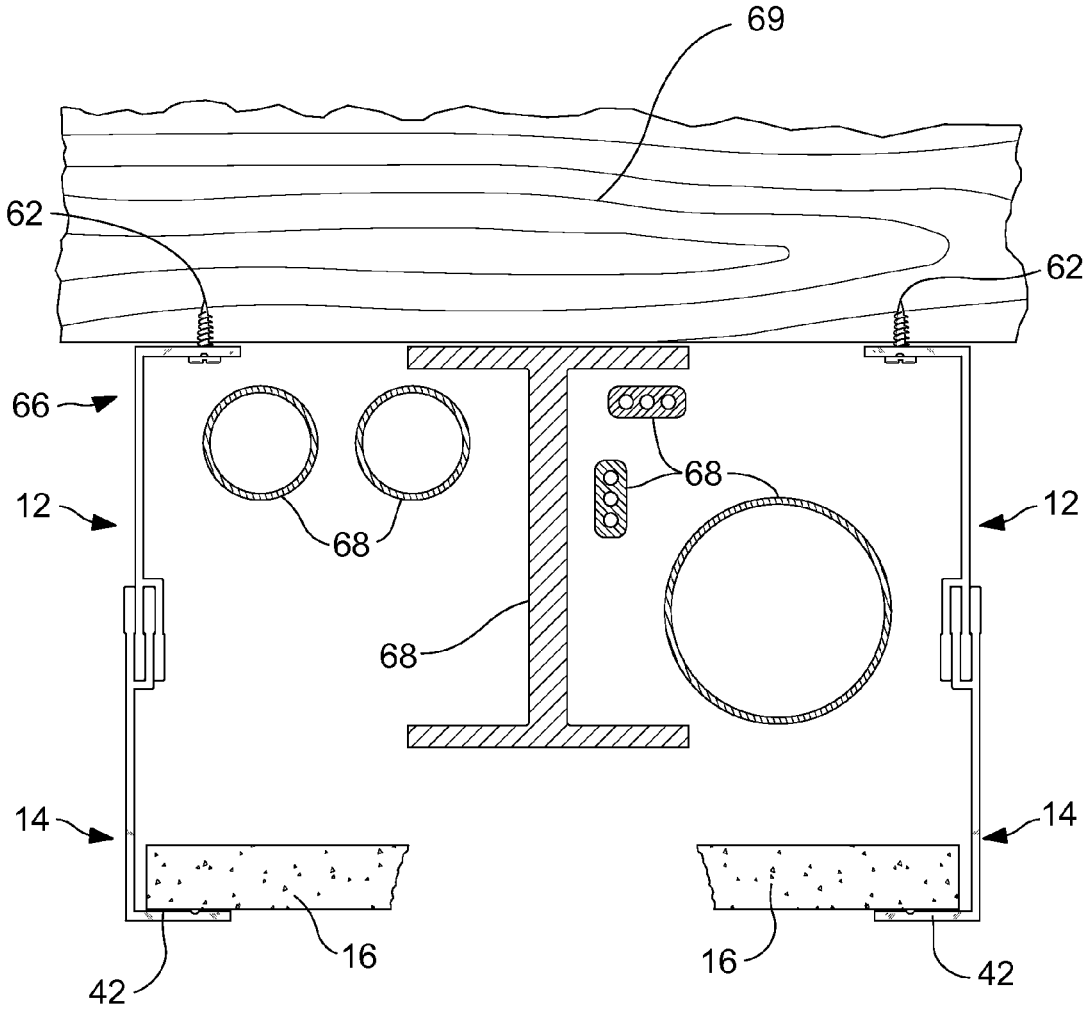
FIG. 5 shows an end, partial section view of the assembled soffit system of FIG. 4 as installed to enclose a beam, utility piping, and wiring.

As shown in FIG. 5, the soffit components 12, 14 can be used in pairs of two soffit components to form a three-sided soffit enclosure 66 for enclosing obstacles or obstructions 68, such as beams, utility piping, or wiring, encountered during installation of ceiling and walls. The first soffit components 12 are attached by the screws 62, applied through fastener grooves 28, to the support surface or substrate 69 such as a joist. In such a case, the second support flange 42 of each pair of soffit components 12, 14, together, can then support the ceiling panel 16 or other structure.

Figure 6:
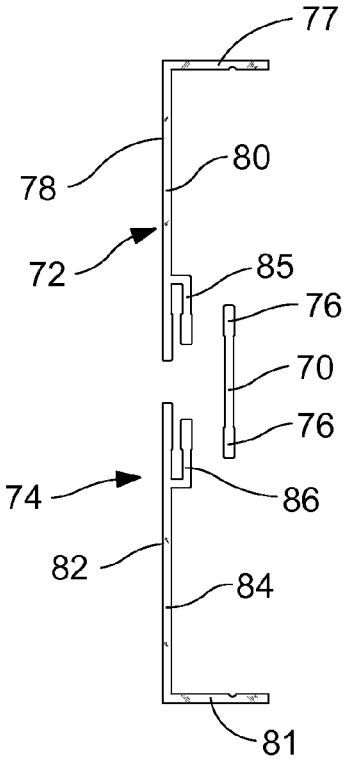
FIG. 6 shows an exploded end view of another example of part of a soffit system according to the teachings of the present invention with two components and a connector key.
Figure 7:
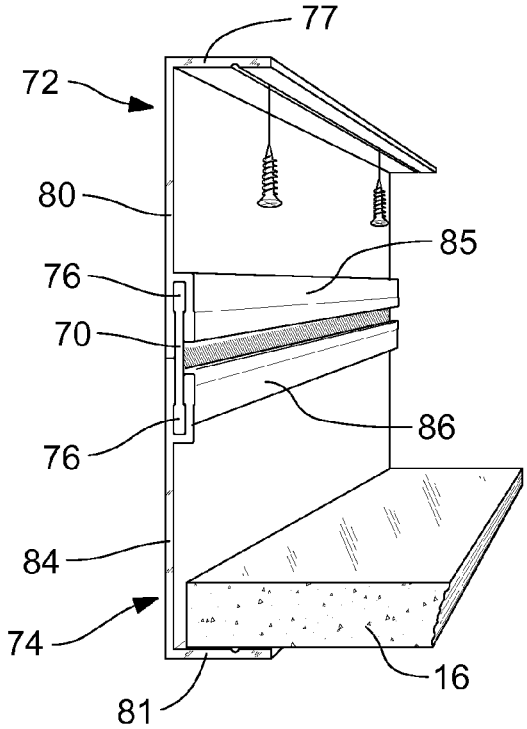
FIG. 7 shows a perspective, lengthwise fragmentary view of the soffit system of FIG. 6 in an assembled state and supporting a panel.
Figure 8:
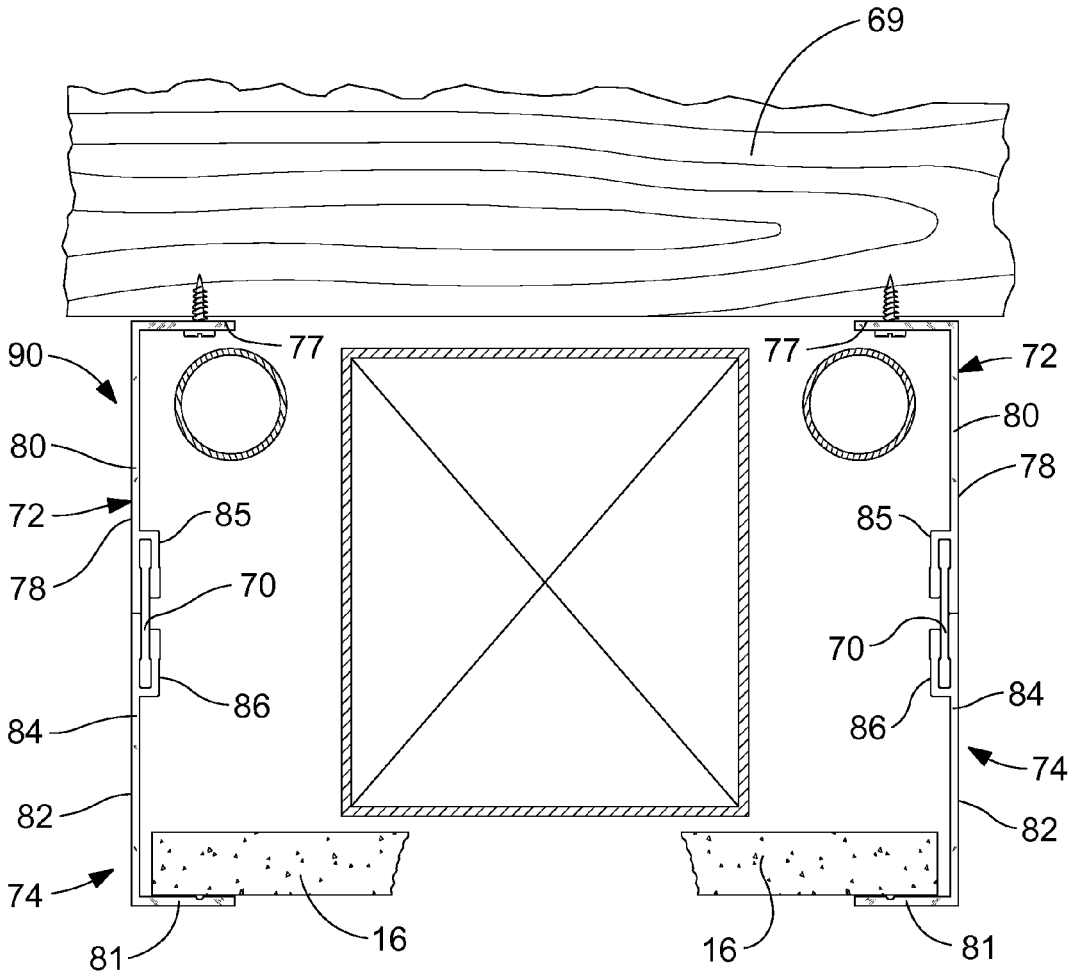
FIG. 8 shows an end partial section view of the assembled soffit system of FIG. 7 as installed over ductwork and utility piping.

In an alternate example as shown in FIGS. 6 and 7, a key 70 can be used to interconnect a first soffit component 72 and a second soffit component 74, or the earlier described components 12, 14. In this example, the soffit components 72, 74 can be similar or identical to the soffit components of FIG. 1, and each has a respective support flange 77, 81, sidewall 80, 84, and connector leg 85, 86 carried on each sidewall 80, 84. Each sidewall 80, 84 has an outside surface 78, 82. The key 70 has a length, a width, and two free edges. Each free edge of the key 70 has a respective paddle-shaped head 76. When the key 70 is assembled with two soffit components 72, 74 as shown in FIG. 7, each head 76 of the key 70 is retained between a sidewall 80, 84 and a connector leg 85, 86 of each soffit component 72, 74, respectively. When the soffit components 72, 74 are interconnected using the key 70, the outside surface 78 of the first sidewall 80 and the outside surface 82 of the second sidewall 84 are coplanar. The coplanar outside surfaces 78, 82 form a smooth continuous side of the soffit enclosure 90, as shown in FIG. 8, when assembled and installed.

Figure 9:
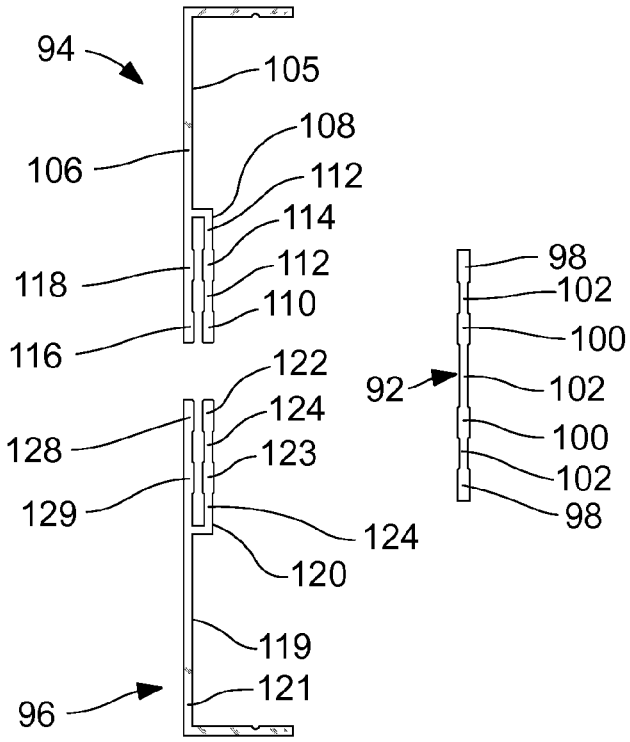
FIG. 9 shows an exploded end view of another example of part of a soffit system according to the teachings of the present invention.
Figure 10:
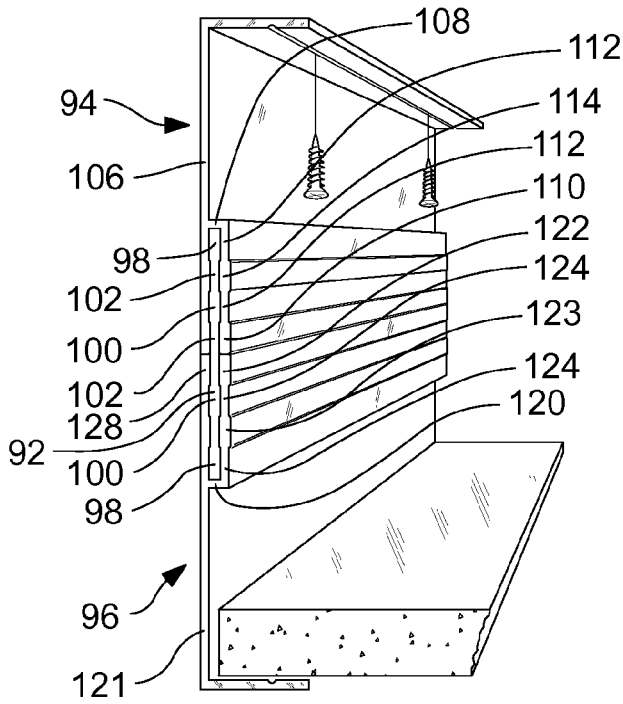
FIG. 10 shows a perspective, lengthwise fragmentary view of the soffit system of FIG. 9 in an assembled state and supporting a panel.

In another alternate example, shown in FIGS. 9 and 10, an alternate key 92 can be used to interconnect an alternate first soffit component 94 and second soffit component 96. The key 92 in this example has a length, a width, and two free edges. Each edge of the key 92 has a respective paddle-shaped head 98. The key 92 also has additional beads 100 that are additional thicker sections along the width of the key 92. The beads 100 are spaced from the heads 98 and alternate with stems 102 along the width of the key 92.

As shown in FIG. 9, a first soffit component 94 has a first inside surface 105 of a first sidewall 106. A first connector leg 108 is carried on the inside surface 105. The first connector leg 108 has a thicker head 110, and an additional thicker bead 114 separated by a thinner stem section 112 from the head 110. The first sidewall 106 also has a bead 118 on the inside surface 105, spaced from a head 116 of the sidewall 106.

A second soffit component 96 for use with the alternate key 92 is similarly constructed. The second soffit component 96 has a second inside surface 119 of a second sidewall 121. The second soffit component 96 also has a second connector leg 120 carried on the inside surface 119. The second connector leg 120 has a thicker head 122, and an additional thicker bead 123 spaced from the head 122 by a thinner stem section 124.

The second sidewall 121 also has a thicker bead 129 spaced from the head 128 along the inside surface 119 of the second sidewall 121. The stem sections 112, 124 of the first and second connector legs 108, 120 are the same length as the beads 100 of the key 92. The stem 112 and the bead 114 of the first soffit component 94 can interlock with the head 98, the bead 100, and the stem 102 of the alternate key 92, when assembled as in FIG. 10. The head 128, the bead 122, and the stem 124 of the second soffit component 96 can interlock with the head 98, the bead 100, and the stem 102 of the alternate key 92, when assembled as in FIG. 10. The soffit components 94, 96 are configured to interconnect with the key 92 as shown in FIG. 10. When assembled, the key 92 is positively retained between the sidewalls 106, 121, and the connector legs 108, 120 of the soffit components 94, 96. The wider key 92 and multi-head shape in this example can help retain the assembly and provide rigidity to the assembled enclosure walls.

Figure 11:
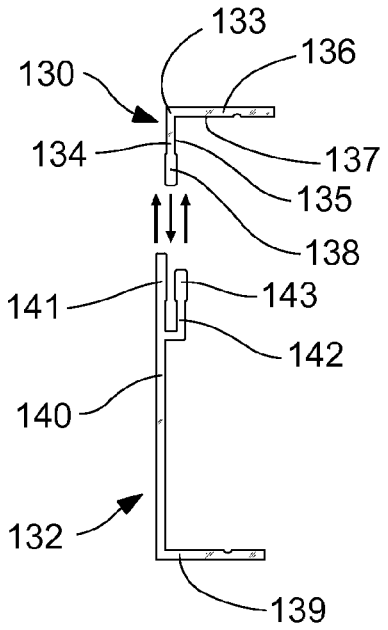
FIG. 11 shows an exploded end view of another example of part of a soffit system according to the teachings of the present invention.

In another alternate example shown in FIG. 11, the first of the two soffit components 130, 132 may be an alternate support component 130, and the second may be a soffit component 132 similar to the earlier described components. The support component 130 in this example has a length, and when viewed in cross-section is L-shaped. The support component 130 may include only a first support flange 136, and a short sidewall 134 that has a single thicker head 138 at a sidewall edge. The support flange 136 and the sidewall 134 are joined along a lengthwise seam 133. The support flange 136 has an inside surface 137. The sidewall 134 has an inside surface 135. The inside surface 135 and the inside surface 137 are oriented relative to one another at a non-parallel angle, also typically, but not necessarily, at an angle of 90 degrees. The support component 130 has no discrete connector leg separate from the sidewall 134 as in the earlier examples. Instead, the head 138 and free edge of the sidewall 134 act as the connector. The second soffit component 132 has a support flange 139, a second sidewall 140, and a connector leg 142 carried on the sidewall 140, similar to the second soffit component 14 of FIG. 1. The second sidewall has a thicker head 141. The connector leg 142 also has a thicker head 143.

Figure 12:
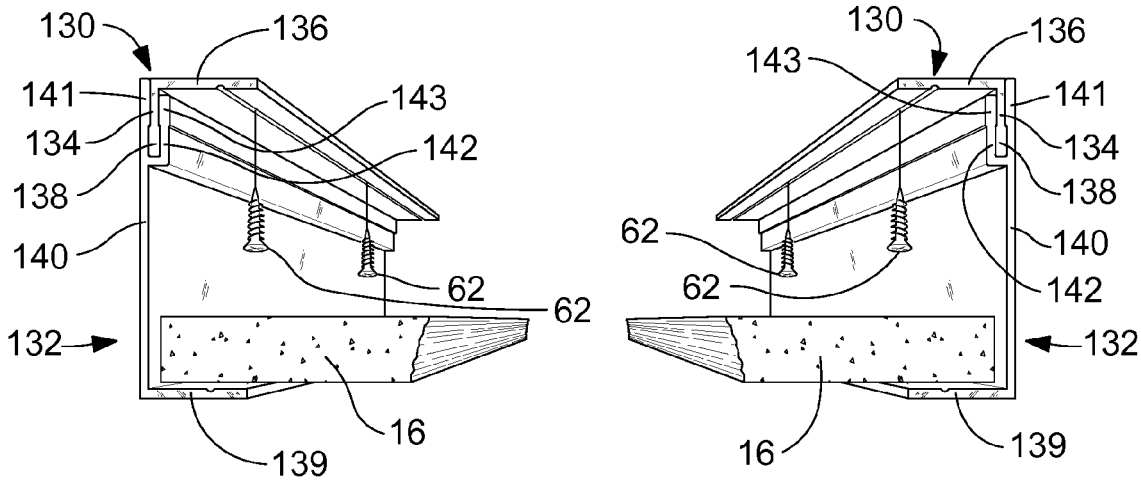
FIG. 12 shows a perspective, lengthwise fragmentary view of the soffit system of FIG. 11 in an assembled state and supporting a panel.
Figure 13:
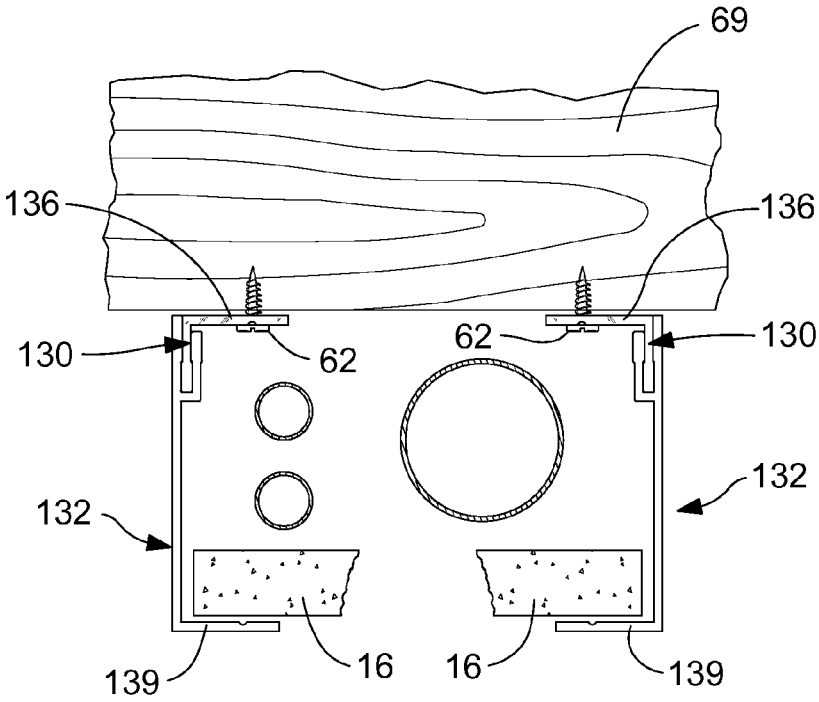
FIG. 13 shows an end view of the assembled soffit system of FIG. 12 and installed over utility piping.

When assembled and installed as shown in FIGS. 12 and 13, the short sidewall 134 of the support component 130 and the second soffit component 132 are placed in a confronting position relative to the second sidewall 140 and the connector leg 142 carried on the second sidewall 140. The support component 130 and second soffit component 132 can be interconnected by pushing the short sidewall 134 between the second sidewall 140 and the second connector leg 142. The head 138 of the short sidewall 134 passes between the second sidewall head 141 and the head 143 of the connector leg 142. The short sidewall 134 is then retained between the second sidewall 140 and the connector leg 142. FIG. 13 shows the system of this example as assembled and installed with the support flanges 136 of the support components 130 fastened by screws 62 to a support surface or joist 69.

Figure 14:
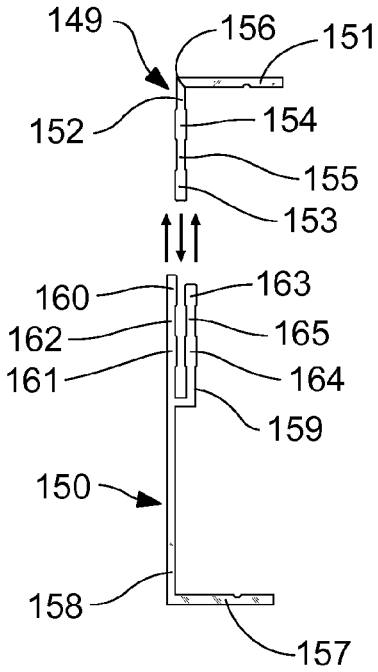
FIG. 14 shows an exploded end view of another example of part of a soffit system according to the teachings of the present invention.

In FIG. 14, another example of a soffit system features an alternate support component 149 having a support flange 151 and a short sidewall 152 joined together along a lengthwise joint 156. The short sidewall 152 in this example has a head 153 and an additional thicker bead section 154. The bead section 154 is spaced from the head by a stem section 155 that is thinner than the head 153 and the additional bead section 154. The corresponding second soffit component 150 has a second flange 157, a sidewall 158, and a connector leg 159 carried on the second sidewall 158. The sidewall 158 has a free edge that has a thicker head 160 and a thicker bead 161 spaced from the head by a thinner section of the sidewall 162. The connector leg 159 has a free edge that has a thicker head 163. The connector leg 159 also has a thicker bead 164 spaced from the head 163 by a stem section 165. The length of the thin section 162 of the sidewall 158 and the length of the stem section 165 are the same as the length of the bead 154 of the support component 149.

To assemble the alternate support component 149 and the alternate soffit component 150, the alternate short sidewall 152, and the second sidewall 158 and second connector leg 159 are placed in a confronting position relative to each other The sidewall 152 of the support component 149 is then pushed between the sidewall 158 and the connector leg 159. The head 153, the bead 154, and the stem 155 of the alternate support component 149 can interlock with the heads 160, 163, the beads 161, 164, and the stems 162, 165 of the alternate soffit component 150 when assembled. When the alternate support component 149 is interconnected with the alternate soffit component 150, the sidewall 152 of the support component 149 is positively retained between the sidewall 158 and the connector leg 159 of the alternate soffit component 150.

Figure 15:
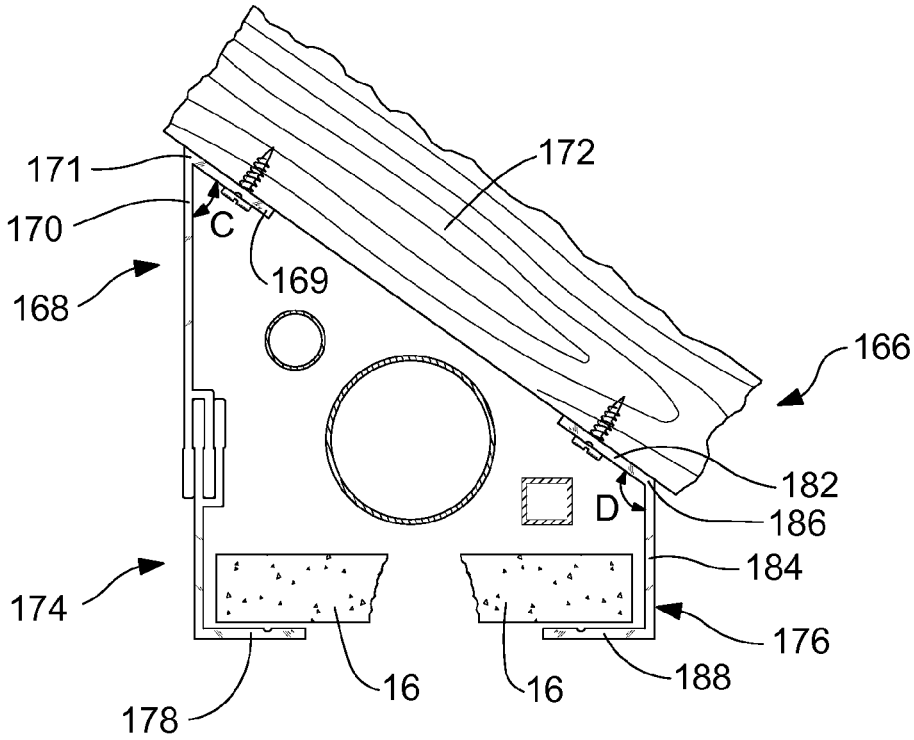
FIG. 15 shows an end partial section view of another example of an alternate embodiment of an assembled and installed soffit system according to the teachings of the present invention.

In another example shown in FIG. 15, a soffit system 166 has three soffit components 168, 174, and 176. The first soffit component 168 has a support flange 169 and a sidewall 170 that are joined at a lengthwise joint 171. The support flange 169 and the sidewall 170 are oriented relative to one another at an adjustable angle C of the joint 171. In this example, the joint 171 is a live joint or living hinge that allows the angle C to vary if the surface 172 to which the soffit system is to be attached varies from level or is at in incline. The second soffit component 174 is similar to the second soffit component of FIG. 6. The third soffit component 176 is another example of a soffit component and has a first support flange 182 and a first sidewall 184 that are joined along a lengthwise seam 186 that is a live joint or living hinge. An angle D between the flange 182 and the sidewall 184 can vary if the substrate to which the soffit system is to be attached varies from level or inclined. The panel 16 is supported on a flange 178 of component 174 and flange 188 of component 176.

Figure 16:
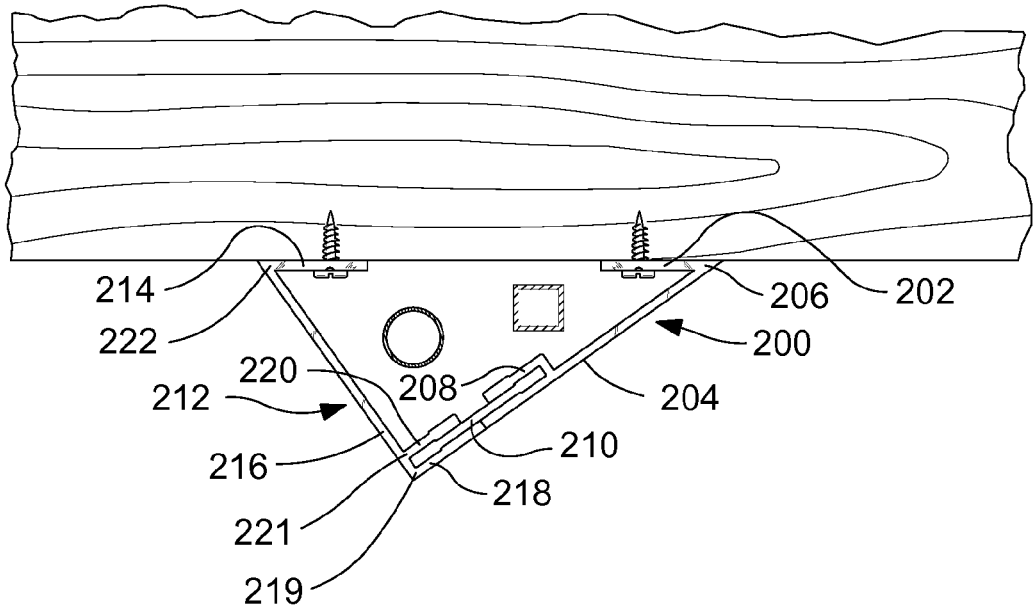
FIG. 16 shows an end section view of an alternate assembled soffit system according to the teachings of the present invention.

FIG. 16 illustrates that soffit components according to the present disclosure can be manufactured in a variety of combinations of support flanges, sidewalls, joints, and connectors. In the example of FIG. 16, a soffit component 200 has a support flange 202 and a sidewall 204 joined at a seam 206 that is a live joint 206 or living hinge that can adjust to an angled installation. The soffit component 200 can have a connector leg 208 that can interconnect with a key 210. Another soffit component 212 can have a support flange 214, a sidewall 216 having an angled stem 218, and an angled connector leg 220. The angled connector stem 218 and the angled connector leg 220 can be joined to sidewall 216 at respective seams 219, 221 that are also live joints. The support flange 214 and the sidewall 216 can be joined at a seam 222 that is a live joint or living hinge. As further illustrated by FIG. 16, the soffit components 200, 212 can be capable of interconnecting with a key 210 to form a two-sided soffit enclosure on a level or an inclined surface. In the example of FIG. 16, no panel is required to create the enclosure.

Figure 17:
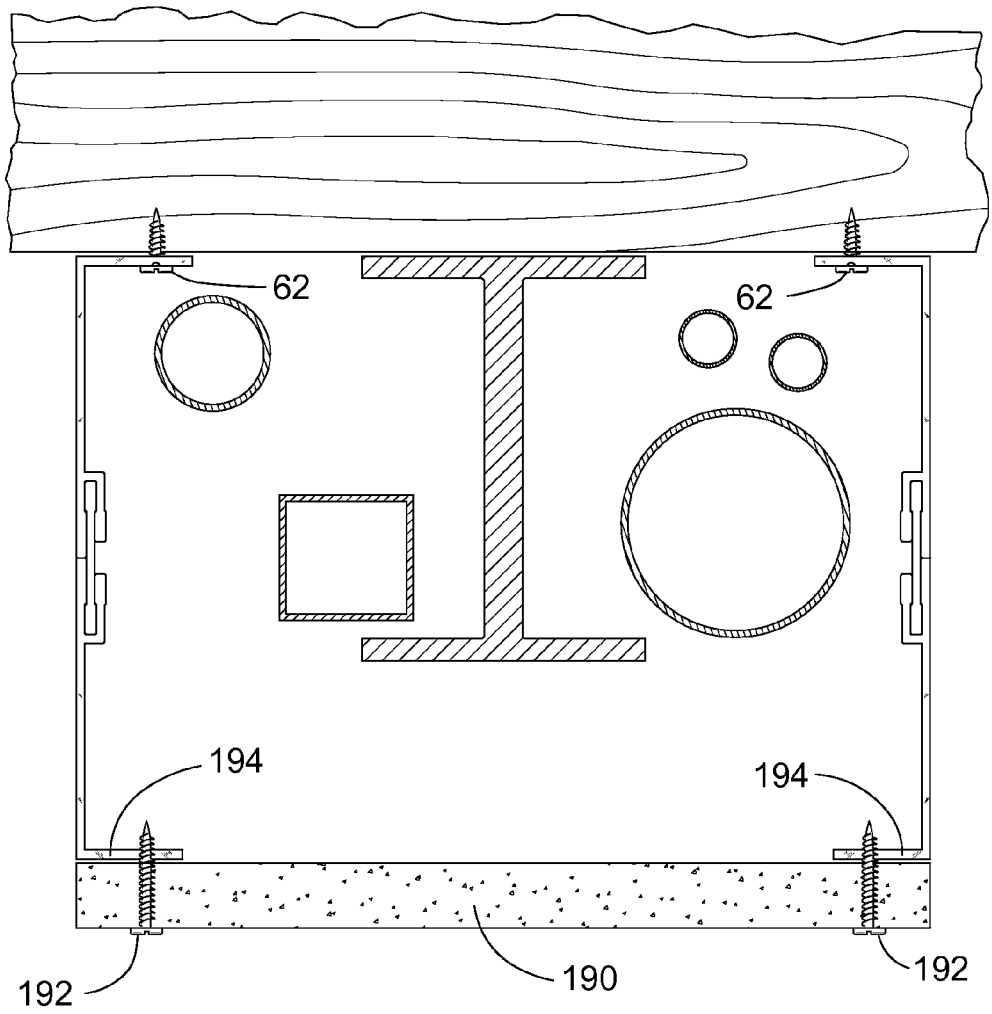
FIG. 17 shows an end partial section view of another example of an assembled and installed soffit system of FIG. 6 with an alternate panel support configuration.

FIG. 17 illustrates an alternate method of installing a panel 190 or the like using any one of the disclosed systems. Screws 192 can be used to fasten the panel 190 to the underside or outside of the second support flanges 194. This alternate is a more permanent method of attachment that may be useful in a particular application or environment.

Figure 18:
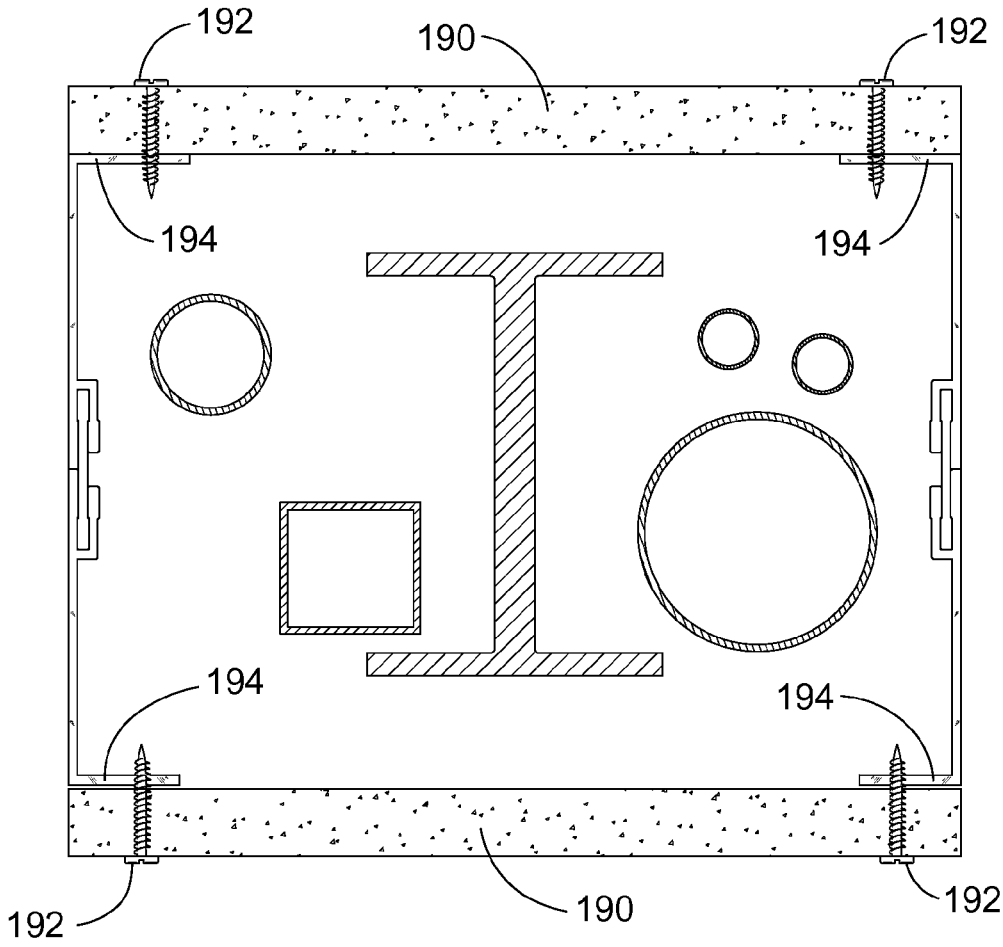
FIG. 18 shows another example of an assembled and installed soffit system as a four-sided enclosure utilizing an alternate panel support configuration.

FIG. 18 shows two panels 190 installed with the soffit system of FIG. 8 to form a four-sided enclosure. Screws 192 can be used to fasten the panels 190 to the outside of the support flanges 194. This alternate can be used for vertical applications, for example.

In other embodiments, the lengths of the sidewalls of the soffit components can vary to accommodate varying installation requirements. Panels of various materials can be mounted using the disclosed soffit systems to cover beams, ducts, piping, conduit, etc. in an aesthetic, economical, three-dimensional manner.

The soffit components of the disclosed soffit systems can be extruded from PVC. In addition, the soffit system can be manufactured in a wide variety of other materials, depending on the suitability of a material to a particular use. Any number of the disclosed components can be used within any other of the components to create a variety of connections and installed configurations. Other varied applications can include suspended ceilings and vertical wall applications as well as those applications introduced elsewhere.

An important consideration in all of the soffit system examples is the degree of flexibility required to maintain the retention of the stem sections and heads or beads in their respective cavities or spaces. For example, metal and plastic corner connectors are well suited for ceiling or wall panel applications. As to manufacturing requirements, a preferred standard length of each soffit component would be approximately eight feet per unit, but the lengths can vary. For example, the soffit components can also be manufactured in extreme lengths or the components can be cut to custom shorter lengths.

Load capacity depends upon the relationship between the flexibility of the material and the resistance to engagement and disengagement inherent in the sidewalls and connector legs and/or the difference in thickness between the stem sections and the heads. In other examples, the sidewalls and connectors could also be modified with other types of mechanisms for the soffit components that permit connection and disconnection of the two component strips. The load capacity could be altered depending on the connection mechanism utilized. The angled transition surfaces, or ramps, between stems and heads can vary. Modification of the geometry of the transition ramps will also affect forces necessary to install and detach a pair of soffit components.

In general, the more flexible the material, the less the load which can be supported. However, a greater difference in thickness between the stems and paddle-shaped upper ends can compensate for a more flexible material. If the paddle-shaped ends are relatively thicker than the stems, then the resistance to engagement or disengagement may be greater.

Although certain soffit systems, components, and methods have been described herein in accordance with the teachings of the present disclosure, the scope of coverage of this patent is not limited thereto. On the contrary, this patent covers all embodiments of the teachings of the disclosure that fairly fall within the scope of permissible equivalents. It will be apparent to those of ordinary skill in the art that changes, additions and/or deletions may be made to the disclosed examples without departing from the spirit and scope of the invention. The foregoing description is given for clearness of understanding only, and no unnecessary limitations should be understood therefrom. Modifications within the scope of the invention may be apparent to those having ordinary skill in the art.

What is claimed is:

1. A soffit system comprising:

an elongate first soffit component consisting of a first support flange having an inner surface and an outer surface, and a first sidewall having a first end and a second end, the first end integrally connected to and extending from the first support flange at the inner surface thereof forming a lengthwise first joint and a first angle between the first support flange and the first sidewall, the first support flange attachable to a panel along the outer surface thereof, the first angle being greater than zero, and the second end of the first sidewall terminating in a first connector, and an elongate second soffit component consisting of a second support flange and a second sidewall having a first end and a second end, the first end of the second sidewall integrally connected to the second support flange forming a second joint and a second angle between the second support flange and the second sidewall, the second flange supporting a panel thereon, the second angle is greater than zero, the second end of the second sidewall terminating in a second connector, an elbow extending from the second sidewall, the elbow spaced from the second support flange and the second end of the second sidewall, and a second connector leg connected to the second connector via the elbow, the second connector leg spaced from and parallel to the second connector forming a gap, the gap for receiving the first connector, wherein the first connector and the second connector are pushed toward one another in a direction parallel to the first sidewall and to the second sidewall to join the first and second soffit components, and are pulled apart to separate the first and second soffit components.

2. A soffit system according to claim 1, wherein the first and second soffit components push together and interlock with one another having positive retention.

3. A soffit system according to claim 1, wherein a first connector leg is carried on the first sidewall and is spaced from and parallel to the first joint extending in the lengthwise direction.

4. A soffit system according to claim 1, wherein the first and second soffit components are identical, and wherein the second soffit component is oriented to a position that is a minor image of the first soffit component.

5. A soffit system according to claim 1, wherein an edge of the first sidewall of the first soffit component interferingly fits between the second sidewall and second connector leg of the second soffit component when the first and second soffit components are lengthwise selectively connected to one another.

6. A soffit system comprising:

an elongate first soffit component having a first support flange and a first sidewall integrally connected to one another along a lengthwise first joint, and having a first connector carried on the first sidewall extending in the lengthwise direction, the first sidewall oriented at a non-parallel angle relative to the first support flange; and an elongate second soffit component having a second support flange and a second sidewall integrally connected to one another along a lengthwise second joint, and having a second connector carried on the second sidewall, and a second connector leg carried on the second sidewall spaced from and parallel to the second joint, and the second connector and the second connector leg extending in the lengthwise direction, the second sidewall oriented at a non-parallel angle relative to the second support flange, wherein the first connector and the second connector are pushed toward one another to join the first and second soffit components, and are pulled apart to separate the first and second soffit components, wherein the first and second connectors each have a stem section integrally extending from a respective one of the first and second sidewalls and each stem section has a head extending along a free edge, wherein each head has a thickness that is greater than the thickness of the corresponding stem section, wherein the second connector leg has a head on an edge thereof, and wherein the head has a thickness that is greater than the thickness of the corresponding second connector leg.

7. A soffit system according to claim 6, wherein a spacing between the second connector leg and the second sidewall matches the thickness of the head of the first connector.

8. A soffit system according to claim 6, wherein each head has a rounded tip and ramps that transition from sides of the head to adjacent side surfaces of the corresponding stem section or the corresponding second connector leg.

9. A soffit system according to claim 1, wherein a fastener groove extends lengthwise along an inside surface of each of the first and second support flanges.

10. A soffit system according to claim 1, wherein two pairs of the first and second soffit components can be mounted to support at least one panel on an inside surface or an outside surface of the support flanges of each pair.

11. A soffit system according to claim 1, wherein an outside surface of the first support flange is mounted against a ceiling or wall surface.

12. A soffit system comprising:

an elongate first soffit component having a first support flange and a first sidewall integrally connected to one another along a lengthwise first joint, and having a first connector carried on the first sidewall extending in the lengthwise direction, the first sidewall oriented at a non-parallel angle relative to the first support flange; and an elongate second soffit component having a second support flange and a second sidewall integrally connected to one another along a lengthwise second joint, and having a second connector carried on the second sidewall, and a second connector leg carried on the second sidewall spaced from and parallel to the second joint, and the second connector and the second connector leg extending in the lengthwise direction, the second sidewall oriented at a non-parallel angle relative to the second support flange, wherein the first connector and the second connector are pushed toward one another to join the first and second soffit components, and are pulled apart to separate the first and second soffit components, wherein a first connector leg is carried on the first sidewall and is spaced from and parallel to the first joint, and wherein the soffit system further comprises an elongate key with first and second edges, wherein the first and second soffit components interlock with a respective edge of the key, and wherein each edge of the key is retained in the space between the inside surface of the sidewall of each soffit component and the respective one of the first and second connector legs of each soffit component and wherein each soffit component can be selectively connected to and disconnected from the key.

13. A soffit system according to claim 1, wherein the soffit components are extruded from PVC.

14. A soffit system according to claim 1, wherein the lengthwise first joint is a living hinge.

15. A soffit system comprising:

an elongate first soffit component having a first support flange and a first sidewall integrally connected to one another along a lengthwise first joint, having a first connector carried on the first sidewall, and having a first connector leg carried on the first sidewall spaced from and parallel to the first joint extending in the lengthwise direction with a spacing between the first connector and first leg, the first sidewall oriented at a non-parallel angle relative to the first support flange;

an elongate second soffit component having a second support flange and a second sidewall integrally connected to one another along a lengthwise second joint, having a second connector carried on the second sidewall, and having a second connector leg carried on the second sidewall spaced from and parallel to the second joint extending in the lengthwise direction with a spacing between the second connector and second legs, the second sidewall oriented at a non-parallel angle relative to the second flange; and an elongate key having first and second edges, wherein the first and second connectors are pushed toward one another onto a respective edge of the key and interlock with the key having positive retention when interconnected by the key, wherein each soffit component can be selectively connected to and disconnected from the key, and wherein each edge of the key is respectively retained in the spacing between the first connector and first connector leg and the spacing between the second connector and second connector leg in order to connect the two soffit components.

16. A soffit system according to claim 15, wherein an outside surface of the first sidewall of the first soffit component is coplanar with the outside surface of the second sidewall of the second soffit component when the soffit components are assembled with the key.

17. A soffit system according to claim 15, wherein the key has a stem section connecting the first and second edges and has a head on each edge, and wherein each head has a thickness that is greater than a thickness of the adjacent stem section.

18. A soffit system according to claim 17, wherein spacing between the first connector and the first connector leg, and the spacing between the second connector and the second connector leg match the thickness of the heads of the key.

19. A soffit system according to claim 17, wherein each head has a rounded tip and ramps that transition from the head thickness to adjacent surfaces of the corresponding stem section.

20. A soffit system according to claim 17, wherein the key has at least one thicker bead on the stem section spaced from the first and second edges, wherein the bead is separated from each of the heads by a respective short stem section, and wherein the length of each short stem section is equal to the length of a head on each of the first and second connectors and the length of a head on the free end of each of the first and second connector legs.

21. A soffit system according to claim 1, wherein the soffit system includes the panel supported on an inside surface of the second support flange.

22. A soffit system according to claim 1, wherein the soffit system is a kit including at least two of the first soffit components and at least two of the second soffit components and at least one panel so as to allow a user to install a three sided soffit enclosure.

23. A soffit system according to claim 1, wherein the first connector and the second connector are interconnected by pushing the first connector between the second sidewall and the second connector leg.

24. A soffit system according to claim 1, further comprising:

a first connector leg carried on the first sidewall spaced from and parallel to the first joint and extending in the lengthwise direction, wherein, when the first and second soffit components are joined, the second connector leg is captured between the first sidewall and the first connector leg, and the first sidewall is captured between the second sidewall and the second connector leg.

25. A soffit system according to the claim 7, further comprising:

a first connector leg carried on the first sidewall spaced from and parallel to the first joint and extending in a lengthwise direction; and a head on an edge of the first connector leg having a thickness that is greater than the thickness of the first connector leg, wherein a spacing between the first connector leg and the first sidewall matches the thickness of the head of the second connector.

* * * * *